US006964228B2

(12) United States Patent
Koizumi et al.

(10) Patent No.: US 6,964,228 B2
(45) Date of Patent: Nov. 15, 2005

(54) CONVEYING DEVICE

(75) Inventors: Takashi Koizumi, Kanagawa (JP); Kazuoki Komiyama, Kanagawa (JP); Yoshinori Kawamura, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/697,652

(22) Filed: Oct. 31, 2003

(65) Prior Publication Data

US 2004/0139874 A1 Jul. 22, 2004

(30) Foreign Application Priority Data

Nov. 1, 2002 (JP) ..... 2002-319452

(51) Int. Cl.[7] ..... B65H 3/44; B65H 5/10

(52) U.S. Cl. ..... 101/477; 271/106; 271/186; 414/416.07; 198/750.12

(58) Field of Search ..... 101/477, 401.1, 101/483; 271/9.08, 9.11, 99, 100, 102, 106, 271/161, 162, 164, 184, 185, 186, 188, 9.07; 414/416.07, 416.03; 198/717, 736, 738, 746, 198/747, 750.1, 750.11, 750.12

(56) References Cited

U.S. PATENT DOCUMENTS 3,776,393 A 12/1973 Bargstedt
4,155,546 A * 5/1979 Jacobs ..... 271/11
4,218,054 A * 8/1980 Bauer et al. ..... 271/11
4,509,736 A * 4/1985 Stahl et al. ..... 271/11
4,759,679 A * 7/1988 Müller ..... 414/416.01
5,176,081 A * 1/1993 Buus ..... 101/477
5,560,596 A * 10/1996 Okoda et al. ..... 271/106

FOREIGN PATENT DOCUMENTS

EP 0 744 363 A2 11/1996
EP 1 055 621 A2 11/2000
JP 61-55034 A 3/1986
JP 09-071348 * 3/1997
JP 2000-351460 A 12/2000

* cited by examiner

*Primary Examiner*—Leslie J. Evanisko
(74) *Attorney, Agent, or Firm*—Sughrue Mion, PLLC

(57) ABSTRACT

A conveying device has: a moving member provided so as to be movable; a rotating member rotatably supported at the moving member; and a holding member rotatably supported at the rotating member, and able to hold a sheet. In a state in which the holding member is holding the sheet, the holding member conveys the sheet by at least one of movement of the moving member, rotation of the rotating member with respect to the moving member, and rotation of the holding member with respect to the rotating member.

16 Claims, 4 Drawing Sheets

CONVEYING DEVICE

CROSS-REFERENCE TO RELATED APPLICATION

This application claims priority under 35 USC 119 from Japanese Patent Application No. 2002-319452, the disclosure of which is incorporated by reference herein.

BACKGROUND OF THE INVENTION

1. Field of the Invention

The present invention relates to a conveying device which conveys sheets.

2. Description of the Related Art

Among automatic printing plate feeding devices for automatically feeding printing plates to an exposure device, there are those which are equipped with a plurality of cassettes (see, for example, Japanese Patent Application Laid-Open (JP-A) No. 2000-351460). The plural cassettes are respectively disposed parallel to the horizontal direction, and are lined up (in one row) in the vertical direction. Printing plates of different sizes are accommodated or stocked in the respective cassettes.

A pick-up member is provided at such an automatic printing plate feeding device. The pick-up member can pick-up (hold) a printing plate at a predetermined pick-up position. This pick-up position is a position which is set apart, in the horizontal direction, from the uppermost cassette.

A predetermined cassette is moved horizontally from the position at which the plural cassettes are lined up (this position will hereinafter be called the "cassette withdrawn position"). The rear end of the predetermined cassette at the time of this horizontal movement moves away from the cassette withdrawn position. Here, in a case in which the predetermined cassette is other than the uppermost cassette, thereafter, the predetermined cassette reaches the pick-up position by being moved in the vertical direction. In this way, due to the pick-up member picking-up (holding) the printing plate and the pick-up member being moved in this state of holding the printing plate, the printing plate is conveyed. Further, by changing the cassette from which the printing plate is picked-up by the pick-up member (i.e., by changing the predetermined cassette), the size of the printing plate fed to the exposure device is changed.

However, in this automatic printing plate feeding device, the pick-up position at which the printing plate is picked-up by the pick-up member is a single place and is fixed. Therefore, when a cassette other than the uppermost cassette is moved vertically toward the pick-up position, in order for that cassette to not interfere with the other cassettes which are at the cassette withdrawn position, the rear end of the cassette, in the direction of the horizontal movement, must be moved away from the cassette withdrawn position at the time when the cassette is moved horizontally.

In this way, the horizontal distance between the pick-up position and the cassette withdrawn position, i.e., the distance over which the cassette moves horizontally, becomes large, and a problem arises in that the device becomes large.

Moreover, a large mechanism for moving the cassette is needed. Therefore, a problem arises in that the cost of the device increases.

In addition, by making small the region through which the printing plate passes at the time when the pick-up member is moved and the printing plate is conveyed, it is possible to prevent the device from becoming even larger.

SUMMARY OF THE INVENTION

In view of the aforementioned, an object of the present invention is to provide a conveying device which can be made compact.

A first aspect of the present invention provides a conveying device comprising: a moving member provided so as to be movable; a rotating member rotatably supported at the moving member; and a holding member rotatably supported at the rotating member, and able to hold a sheet, wherein, in a state in which the holding member is holding the sheet, the holding member conveys the sheet by at least one of movement of the moving member, rotation of the rotating member with respect to the moving member, and rotation of the holding member with respect to the rotating member.

In the above-described conveying device, the moving member is movable, the rotating member is rotatably supported at the moving member, and the holding member is rotatably supported at the rotating member. In the state in which the holding member is holding the sheet, the sheet is conveyed by at least one of movement of the moving member, rotation of the rotating member with respect to the moving member, and rotation of the holding member with respect to the rotating member.

Here, the holding member can move due to movement of the moving member, rotation of the rotating member with respect to the moving member, and rotation of the holding member with respect to the rotating member. Therefore, the region over which the holding member can move is large. Thus, the holding member can hold the sheet which is in this large region over which the holding member can move. In this way, the distance over which the sheet is moved in order for the holding member to hold the sheet can be made to be small or can be eliminated. Accordingly, the conveying device can be made compact, the mechanism for moving the sheet can be made to be compact or eliminated, and the costs can be reduced.

Moreover, even in a case in which an obstacle exists at the conveying direction side of the sheet, by moving the holding member by at least one of movement of the moving member, rotation of the rotating member with respect to the moving member, and rotation of the holding member with respect to the rotating member, it is possible to suppress or prevent the sheet from being damaged by the obstacle.

In addition, the holding member can rotate due to the rotation of the rotating member with respect to the moving member, and due to the rotation of the holding member with respect to the rotating member. Therefore, the angle of the holding member with respect to the sheet can be adjusted. In this way, the holding member can reliably hold the sheet.

In the first aspect, the movement of the moving member, the rotation of the rotating member with respect to the moving member, and the rotation of the holding member with respect to the rotating member are driven by respectively different drive sources, and each of the drive sources is controlled independently.

In the present conveying device, the movement of the moving member, the rotation of the rotating member with respect to the moving member, and the rotation of the holding member with respect to the rotating member are driven by respectively different drive sources, and each of the drive sources is controlled independently. Therefore, the position and the angle at which the holding member holds the sheet can be selected from a wide range, the locus of conveying and the direction of conveying of the sheet can be selected from a wide range.

A second aspect of the present invention provides a conveying device comprising a holding member which can hold a sheet and which is movable, wherein, given that a direction of thickness of the sheet is a vertical direction, the holding member holds one end portion of the sheet such that the one end portion is oriented in the vertical direction, and moves and conveys the sheet in the direction in which the one end portion is oriented.

In the above-described conveying device, the sheet is conveyed by the holding member being moved while holding the sheet.

Here, the sheet is conveyed upward due to the holding member moving upward while holding one end portion of the sheet in a state in which this one end portion is directed upward in the vertical direction. Therefore, due to the non-flexing force of the sheet, spreading, in the horizontal direction, of the regions of the sheet other than the one end portion thereof held by the holding member can be suppressed. In this way, the region over which the sheet passes when the sheet is being conveyed can be made to be small, and the conveying device can be made to be compact.

Moreover, because spreading in the horizontal direction of the regions of the sheet other than that one end portion thereof can be suppressed, it is possible to suppress or prevent the sheet from being damaged by an obstacle which exists at the conveying direction side of the sheet.

In the second aspect, the holding member is provided so as to be rotatable.

In the above-described conveying device, by rotating the holding member and adjusting the angle of the holding member with respect to the sheet, the holding member can reliably hold the sheet.

A third aspect of the present invention provides a method of conveying a sheet by a conveying device having: a moving member provided so as to be movable; a rotating member rotatably supported at the moving member; and a holding member rotatably supported at the rotating member and able to hold a sheet, the method comprising: holding the sheet by the holding member; and rotating the rotating member in a state in which the holding member holds the sheet.

A fourth aspect of the present invention provides a printing plate exposure device comprising: (A) a plurality of cassettes disposed in a row in a vertical direction, each of the cassettes accommodating a plurality of printing plates; (B) a conveying device conveying the printing plate and having: (i) a moving member disposed parallel to the plurality of cassettes and provided so as to be movable in a horizontal direction; (ii) a rotating member rotatably supported at the moving member; and (iii) a holding member rotatably supported at the rotating member and able to hold the printing plate; and (C) an exposure section provided at a downstream side of the conveying device in a direction of conveying the printing plate, and recording an image on a conveyed printing plate, wherein, in a state in which the holding member is holding the sheet, the holding member conveys the sheet by at least one of movement of the moving member, rotation of the rotating member with respect to the moving member, and rotation of the holding member with respect to the rotating member.

DETAILED DESCRIPTION OF THE INVENTION

Figure 1:
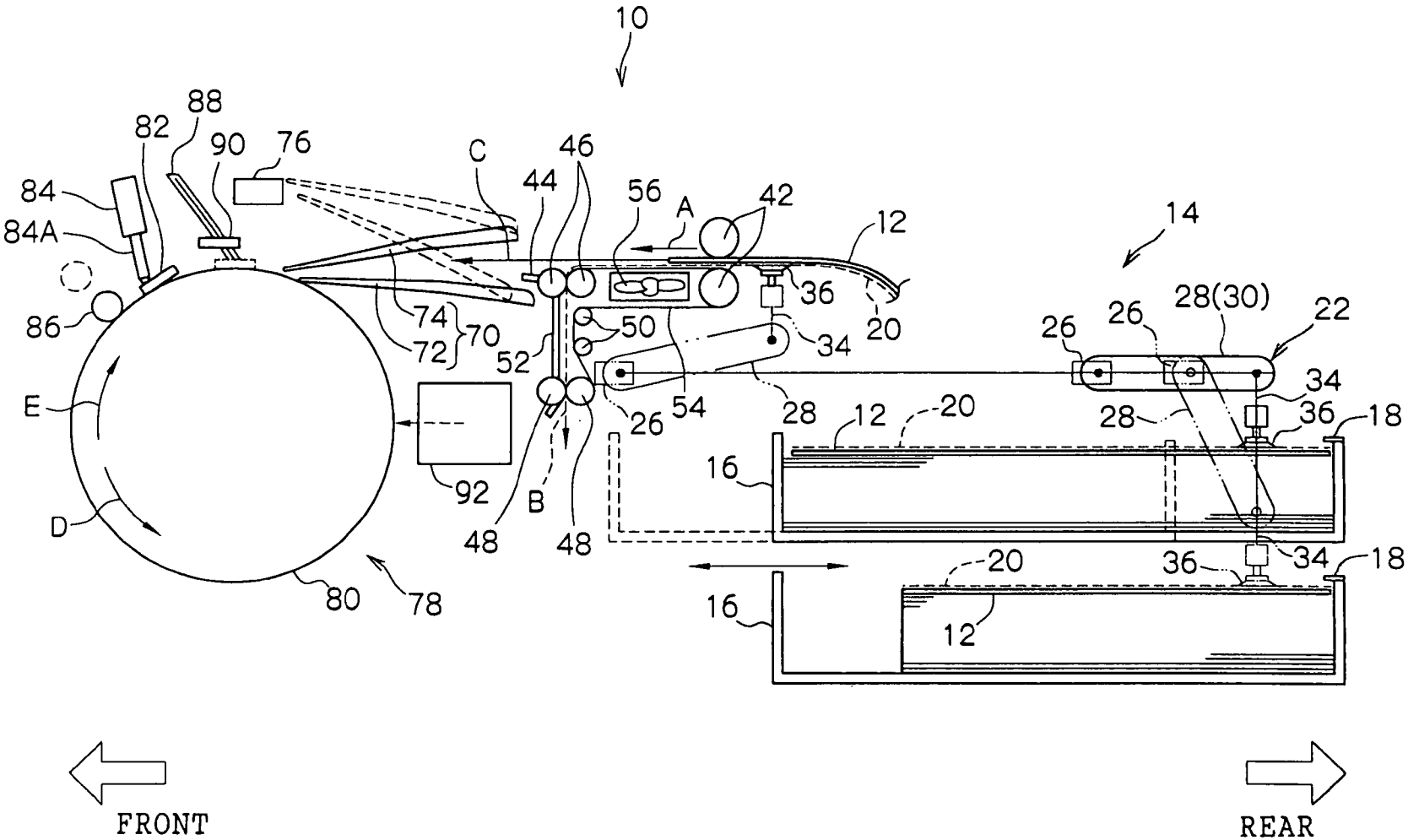
FIG. 1 is a schematic side view of an automatic printing plate exposure device to which a conveying device relating to an embodiment of the present invention is applied.

An automatic printing plate exposure device 10, to which a conveying device relating to an embodiment of the present invention is applied, is shown in side view in FIG. 1.

The automatic printing plate exposure device 10 exposes (records) an image onto an image recording surface 12B (e.g., an emulsion surface) on a support 12A of a printing plate 12 (see FIG. 3) which is a photopoly plate or a thermal plate or the like and which serves as a sheet.

A sheet feeding/conveying section 14 serving as a conveying device is provided at the region at the rear side of the automatic printing plate conveying device 10. A plurality of cassettes 16 (in the present embodiment, two cassettes 16) are provided in the sheet feeding/conveying section 14. Each cassette 16 is formed in the shape of a rectangular parallelepiped box whose top surface is open. The plural cassettes 16 are disposed horizontally and parallel to the surface on which the automatic printing plate exposure device 10 is placed. The plural cassettes 16 are arranged in a row in the direction perpendicular to the surface on which the automatic printing plate exposure device 10 is placed, and are stacked one above the other in plural levels. Moreover, a separating plate 18 is provided at the corner portion at the top portion of the rear side of each cassette 16.

The upper cassette 16 is horizontally movable in the front-back direction (horizontal direction) between a rear side position and a front side position. Due to the upper cassette 16 being disposed at the rear side position, the top of the lower cassette 16 is completely covered by the upper cassette 16. Due to the upper cassette 16 being disposed at the front side position, the top of the rear end portion of the lower cassette 16 is opened.

Figure 3:
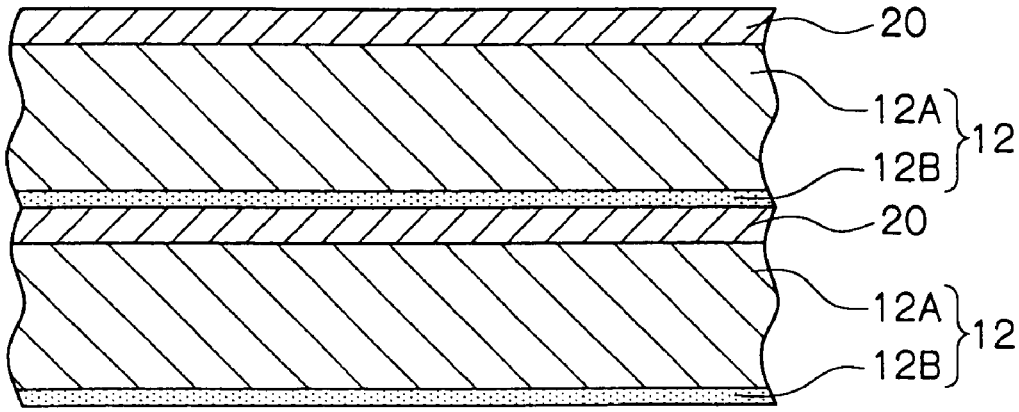
FIG. 3 is a cross-sectional view showing a state in which printing plates and interleaf sheets are accommodated in a cassette in the automatic printing plate exposure device to which the conveying device relating to the embodiment of the present invention is applied.

As shown in FIG. 3, a plurality (a large number) of the printing plates 12 are accommodated or stocked in the cassette 16. The printing plates 12 are stacked with their image recording surfaces 12B facing downward. A thin-sheet-shaped interleaf sheet 20 is disposed directly above each of the printing plates 12. In this way, the interleaf sheets 20 and the printing plates 12 are stacked alternately. The interleaf sheets 20 are the same size as the printing plates 12. The image recording surface 12B of the printing plate 12 is protected by the interleaf sheet 20 therebelow. Further, the printing plates 12 and the interleaf sheets 20 of different sizes are accommodated in the respective cassettes 16 in a state of being set near the rear end sides of the respective cassettes 16.

Figure 2:
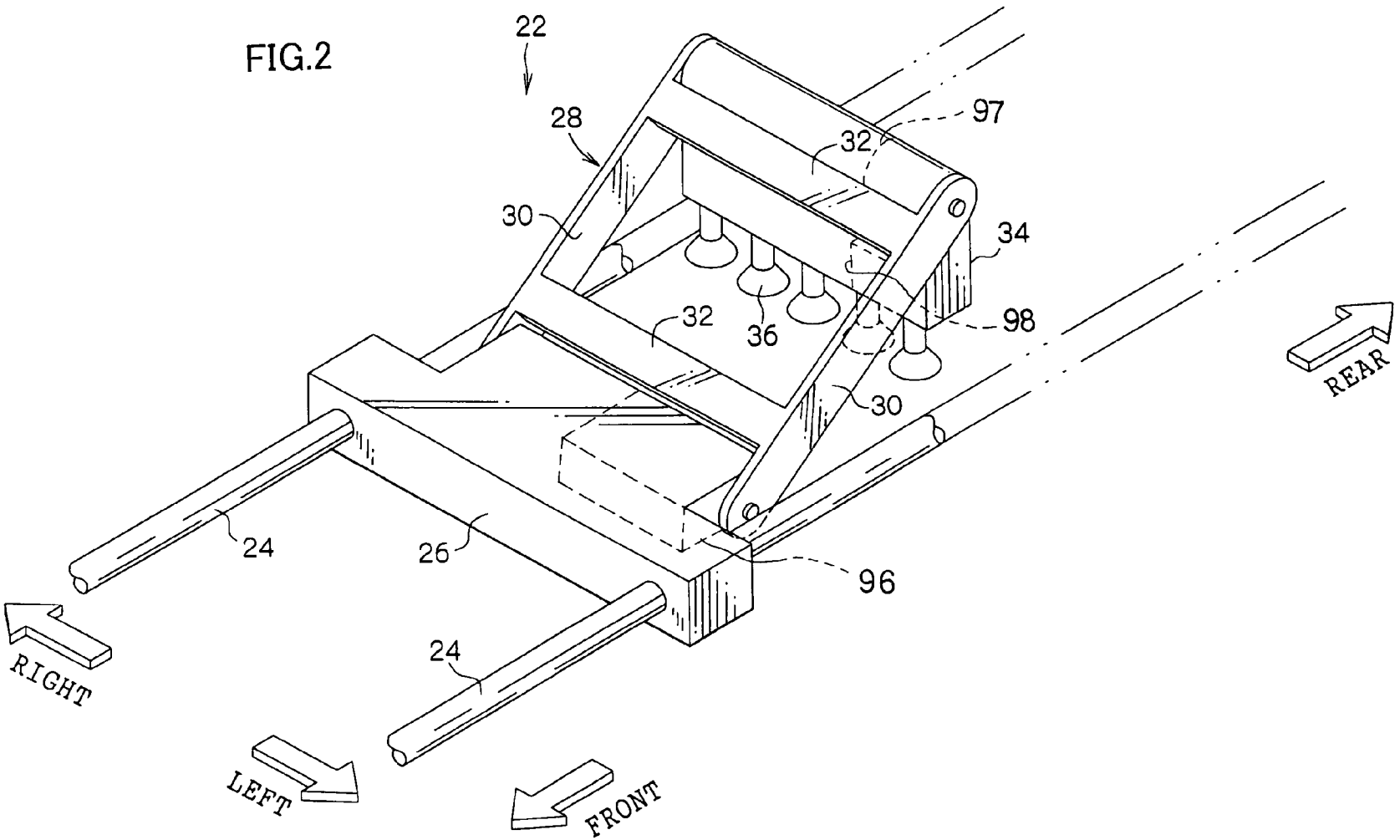
FIG. 2 is a perspective view showing a robot arm mechanism in the conveying device relating to the embodiment of the present invention.

A robot arm mechanism 22 is provided above the upper cassette 16. As shown in FIG. 2, the robot arm mechanism 22 has a pair of rails 24 serving as restricting members. The pair of rails 24 are disposed parallel to the front-back direction above the left-right direction both sides of the upper cassette 16. A moving plate 26 serving as a moving member spans between the pair of rails 24. The moving plate 26 is disposed parallel to the left-right direction above the upper cassette 16. Further, the moving plate 26 is movable horizontally in the front-back direction along the pair of rails 24.

One end of a rotating arm 28 serving as a rotating member is supported rotatably at the moving plate 26. The rotating arm 28 has a pair of rotating plates 30, and is supported by the moving plate 26 at one end of each rotating plate 30. The pair of rotating plates 30 are disposed at the left-right direction outer sides of the upper cassette 16. The rotating arm 28 has a pair of connecting plates 32. The pair of rotating plates 30 are connected together by the pair of connecting plates 32 at the transverse direction end portions in vicinities of ones of ends and the others of ends of the rotating plates 30.

One end of a supporting plate 34 is supported rotatably at the other end of the rotating arm 28 (between the respective other ends of the pair of rotating plates 30). The supporting plate 34 is disposed parallel to the left-right direction.

A plurality of suction pads 36 (e.g., vacuum suction pads) serving as holding members or pick-up members are mounted to the other end of the supporting plate 34. The plural suction pads 36 are rotatably supported at the rotating arm 28 via the supporting plate 34, and are disposed at predetermined pitch intervals along the left-right direction. The plural suction pads 36 are movable in the front-back direction due to the moving plate 26 being moved in the front-back direction. Further, the suction pads 36 are rotatable due to the rotating arm 28 rotating with respect to the moving plate 26, or due to the supporting plate 34 rotating with respect to the rotating arm 28. The bottom portions (skirts) of the suction pads 36 are formed in the shapes of truncated conical tubes and are elastic.

The front-back direction movement of the moving plate 26, and the rotation of the rotating arm 28 with respect to the moving plate 26, and the rotation of the supporting plate 34 and the plural suction pads 36 with respect to the rotating plate 28, are driven by separate driving sources 96, 97 and 98 (refer to the imaginary lines in FIG. 2) respectively, and are controlled independently. Note that, in FIG. 2, the drive sources 96, 97 and 98 are disposed directly at the moving plate 26 and the supporting plate 34. However, the present invention is not limited to the same, and the driving sources 96, 97 and 98 may be disposed at the outer sides of the moving plate 26 and the supporting plate 34, and may indirectly drive the rotating arm 28 and the supporting plate 34.

As shown in FIG. 1, when the upper cassette 16 is disposed at the rear side position, the rotating arm 28 is extended substantially rearward from the moving plate 26, and the supporting plate 34 and the plural suction pads 36 are suspended downward from the rotating arm 28, and the plural suction pads 36 are disposed at the rear end portion of the upper cassette 16. In this way, the lower ends of the suction pads 36 contact the end portion of the uppermost interleaf sheet 20 within the upper cassette 16 (e.g., at a position 50 mm from the edge of that interleaf sheet 20). (Hereinafter, this position of the moving plate 26, the rotating arm 28, the supporting plate 34, and the plural suction pads 36 will be called the "top sucking position".)

On the other hand, when the upper cassette 16 is disposed at the front side position, the moving plate 26 is disposed at the rear side of the top sucking position, the rotating arm 28 is disposed at the clockwise direction side (in FIG. 1) of the moving plate 26, the supporting plate 34 and the plural suction pads 36 are disposed at the counterclockwise direction side (in FIG. 1) of the rotating arm 28, and the supporting plate 34 and the plural suction pads 36 hang downward from the rotating arm 28. In this way, the plural suction pads 36 are disposed at the rear end portion of the lower cassette 16 (directly below the top sucking position of the plural suction pads 36). In this way, the lower ends of the suction pads 36 contact the end portion of the uppermost interleaf sheet 20 in the lower cassette 16 (e.g., at a position 50 mm from the edge of that interleaf sheet 20). (Hereinafter, this position of the moving plate 26, the rotating arm 28, the supporting plate 34, and the plural suction pads 36 will be called the "bottom sucking position".)

The respective suction pads 36 are connected to a suction mechanism (not illustrated) such as, for example, a suction blower or the like. By driving the suction mechanism at the time when the bottom ends of the suction pads 36 contact the uppermost interleaf sheet 20 within the cassette 16, air is sucked from the suction pads 36 to the suction mechanism. In this way, the suction force of the suction pads 36 is transmitted not only to that interleaf sheet 20, but also to the printing plate 12 therebeneath (directly beneath). That interleaf sheet 20 and printing plate 12 are sucked (held) as a pair by the suction pads 36. At this time, the bottom ends of the suction pads 36 elastically deform so as to closely contact the interleaf sheet 20. Leakage of air to the interior of the suction pads 36 is thereby prevented.

The plural suction pads 36 are classified into a plurality of systems. On the basis of the size of the printing plate 12 and the interleaf sheet 20, a system is selected and a sucking function is imparted to the suction pads 36 of the selected system. The suction pads 36 can thereby suck the interleaf sheet 20 and the printing plate 12 in a well-balanced manner.

When the interleaf sheet 20 and the printing plate 12 in the upper cassette 16 are sucked by the suction pads 36, from the top sucking position, the moving plate 26 is moved in the front-back direction, and the rotating arm 28 is rotated counterclockwise (in FIG. 1) with respect to the moving plate 26, and the supporting plate 34 and the plural suction pads 36 are rotated clockwise (in FIG. 1) with respect to the rotating arm 28. In this way, the plural suction pads 36 move directly upward while remaining suspended downward, and the portions of that interleaf sheet 20 and printing plate 12 which portions are being sucked by the suction pads 36 are lifted up (picked-up) and conveyed in a state of being horizontal. At this time, due to that interleaf sheet 20 and printing plate 12 passing by the separating plate 18 of the upper cassette 16, the interleaf sheet 20 and printing plate 12 which are beneath that interleaf sheet 20 and printing plate 12 are separated in spite of static electricity, such that the interleaf sheet 20 and the printing plate 12 are removed (fed-out) as a pair from the upper cassette 16.

Moreover, after the interleaf sheet 20 and the printing plate 12 have passed by the separating plate 18 of the upper cassette 16, the directly upward movement of the plural suction pads 36 is stopped. Hereinafter, this position of the moving plate 26, the rotating arm 28, the supporting plate 34 and the plural suction pads 36 whose movement has stopped is called the "inversion starting position".

On the other hand, when the interleaf sheet 20 and the printing plate 12 in the lower cassette 16 are sucked by the suction pads 36, from the bottom sucking position, the moving plate 26 is moved in the front-back direction, and the rotating arm 28 is rotated counterclockwise (in FIG. 1) with respect to the moving plate 26, and the supporting plate 34 and the plural suction pads 36 are rotated clockwise (in FIG. 1) with respect to the rotating arm 28. In this way, the plural suction pads 36 move directly upward while remaining suspended downward, and the portions of that interleaf sheet 20 and printing plate 12 which portions are being sucked by the suction pads 36 are lifted up (picked-up) and conveyed in a state of being horizontal. At this time, due to that interleaf sheet 20 and printing plate 12 passing by the separating plate 18 of the lower cassette 16, the interleaf sheet 20 and printing plate 12 which are beneath that interleaf sheet 20 and printing plate 12 are separated in spite of static electricity, such that the interleaf sheet 20 and the printing plate 12 are removed (fed-out) as a pair from the lower cassette 16. Moreover, the moving plate 26, the rotating arm 28, the supporting plate 34 and the plural suction pads 36 pass from the bottom sucking position through the top sucking position and reach the inversion starting position.

When the moving plate 26, the rotating arm 28, the supporting plate 34, and the plural suction pads 36 have reached the inversion starting position, the moving plate 26 is moved forward, the rotating arm 28 is rotated counterclockwise (in FIG. 1) with respect to the moving plate 26, and the supporting plate 34 and the plural suction pads 36 are rotated counterclockwise (in FIG. 1) with respect to the rotating arm 28. In this way, the lower ends of the plural suction pads 36 (the sucked points of the interleaf sheet 20 and the printing plate 12) are moved while tracing a so-called cycloid curve, and the interleaf sheet 20 and the printing plate 12 are inverted and conveyed.

The rotation of the rotating arm 28 with respect to the moving plate 26, and the rotation of the supporting plate 34 and the plural suction pads 36 with respect to the rotating arm 28, are stopped when the plural suction pads 36 are oriented directly upward (i.e., have been rotated by 180° from the inversion starting position) In this way, at the upper portion of the interleaf sheet 20 and the printing plate 12, the lower side is the interleaf sheet 20 and the upper side is the printing plate 12. Due to the moving plate 26 moving forward in this state, the interleaf sheet 20 and the printing plate 12 are horizontally conveyed forward.

Here, the horizontal distance between the rear side position and the front side position of the upper cassette 16 (i.e., the horizontal moving distance of the upper cassette 16 with respect to the lower cassette 16) is determined on the basis of the region through which the interleaf sheet 20 and the printing plate 12 pass at the time when the interleaf sheet 20 and the printing plate 12 are conveyed from the lower cassette 16. In this way, even if the interleaf sheet 20 and the printing plate 12 are conveyed from the lower cassette 16, that interleaf sheet 20 and printing plate 12 do not interfere with the upper cassette 16.

Moreover, it is most preferable for the interleaf sheet 20 and the printing plate 12 to not interfere at all with the upper cassette 16. However, if the horizontal distance between the rear side position and the front side position of the upper cassette 16 is made to be small, the sheet feeding/conveying section 14 can be made to be compact. Here, even if the interleaf sheet 20 and the printing plate 12 interfere with the upper cassette 16, they interfere at the reverse surface side (the support 12A side) of the interleaf sheet 20 and the printing plate 12. Therefore, there may be slight contact with the upper cassette 16 at the times when the interleaf sheet 20 and the printing plate 12 are being horizontally conveyed, provided that interference with the upper cassette 16 at the time when the interleaf sheet 20 and the printing plate 12 are being lifted up and conveyed and are being inverted and conveyed is avoided.

A pair of conveying rollers 42 and a guide plate 44 are provided at the front side of the sheet feeding/conveying section 14 (i.e., at the front side of the position where the movement of the plural suction pads 36 stops). The pair of conveying rollers 42 oppose one another in the vertical direction. The interleaf sheet 20 and the printing plate 12 which are being conveyed by the movement of the plural suction pads 36 are transferred to between the pair of conveying rollers 42, and driving of the suction mechanism is stopped such that the sucking of the suction pads 36 is released. The interleaf sheet 20 and the printing plate 12 are thereby conveyed substantially forward along the guide plate 44 by the driving force (rotational force) of the pair of conveying rollers 42.

A pair of guide rollers 46 are disposed, so as to oppose one another in the front-back direction, in front of the lower conveying roller 42. A pair of discharge rollers 48 are disposed, so as to oppose one another in the front-back direction, beneath the pair of guide rollers 46. A pair of small rollers 50 are disposed, so as to be separated from one another, between the rear guide roller 46 and the rear discharge roller 48. An interleaf sheet guide plate 52 is provided between the front guide roller 46 and the front discharge roller 48.

An endless, strip-shaped belt 54 is trained around the lower conveying roller 42, the rear guide roller 46, the rear discharge roller 48, and the pair of small rollers 50. The belt 54 forms a substantially L-shaped loop on the whole, and is driven in the direction of arrow A in FIG. 1. Mesh holes (not illustrated) are formed in the entire belt 54.

A fan 56 is provided at the inner side of the belt 54, between the lower conveying roller 42 and the pair of guide rollers 46. When the interleaf sheet 20, which is being conveyed substantially forward together with the printing plate 12, is conveyed onto the top surface of the belt 54, the interleaf sheet 20 is sucked to the belt 54 by the fan 56 via the mesh holes, such that the sticking together of the interleaf sheet 20 and the printing plate 12 due to static electricity is cancelled. In this way, only the interleaf sheet 20 is conveyed together with the belt 54 in the direction of the chain-line arrow B in FIG. 1, and is guided between the pair of guide rollers 46, and thereafter, is fed to the pair of discharge rollers 48 while being guided by the interleaf sheet guiding plate 52, and is discarded in a discard box (not illustrated) beneath the pair of discharge rollers 48. On the other hand, the printing plate 12, from which the interleaf sheet 20 has been peeled off, passes above the pair of guide rollers 46, and is continuously conveyed substantially forward (in the direction of arrow C in FIG. 1) along the guide plate 44.

A conveying guide unit 70 is provided in front of the guide plate 44. The conveying guide unit 70 has a flat-plate-shaped plate supplying guide 72 and plate discharging guide 74. The relative positional relationship of the plate supplying guide 72 and the plate discharging guide 74 is such that the plate supplying guide 72 and the plate discharging guide 74 form a sideways V shape. The conveying guide unit 70 is structured so as to rotate by a predetermined angle around the rear end portion thereof. Here, the printing plate 12, which is being conveyed substantially forward along the guide plate 44, is conveyed onto the plate supplying guide 72.

A puncher portion 76 is provided in front of and above the conveying guide unit 70. Here, due to the conveying guide unit 70 being rotated such that the plate supplying guide 72 is made to correspond to (oppose) the puncher portion 76, the front end portion of the printing plate 12 on the plate supplying guide 72 is conveyed into the puncher portion 76. In this way, a predetermined number of unillustrated punch holes (e.g., circular holes or long holes or the like) are formed in the front end portion of the printing plate 12 by the puncher portion 76. When processing at the puncher portion 76 has been completed, the printing plate 12 is returned onto the plate supplying guide 72.

An exposure section 78 is provided in front of and beneath the conveying guide unit 70. The exposure section 78 has a cylindrical rotating drum 80. The rotating drum 80 can rotate in the direction of arrow D and in the direction of arrow E in FIG. 1. Here, when the printing plate 12 is returned onto the plate supplying guide 72 from the puncher portion 76, the conveying guide unit 70 is rotated such that the plate supplying guide 72 opposes the exposure section 78 (i.e., corresponds to a direction tangent to the rotating drum 80). The front end of the printing plate 12 is thereby conveyed onto the peripheral surface of the rotating drum 80, and the printing plate 12 is positioned on the rotating drum 80.

Plate-shaped front end chucks 82 are provided at the peripheral surface of the rotating drum 80 at the position to which the front end of the printing plate 12 is conveyed. The front end chucks 82 are supported at the rotating drum 80 so as to be freely rotatable. Elastic force in a direction of moving away from the peripheral surface of the rotating drum 80 is imparted to the front sides of the front end chucks 82.

An attaching unit 84 is provided above the front end chucks 82. Extending/retracting rods 84A are provided at the attaching unit 84. Here, due to the extending/retracting rods 84A of the attaching unit 84 being extended and the front sides of the front end chucks 82 being pushed, the rear ends of the front end chucks 82 move away from the peripheral surface of the rotating drum 80 against the aforementioned elastic force. In this way, the front end of the printing plate 12, which is conveyed onto the peripheral surface of the rotating drum 80 from the plate supplying guide 72 as described above, is inserted between the rear ends of the leading end chucks 82 and the peripheral surface of the rotating drum 80. In this state, positioning of the printing plate 12 is carried out.

After positioning of the printing plate 12 has been completed, the extending/retracting rods 84A of the attaching unit 84 are pulled back such that the pressing of the front sides of the front end chucks 82 is cancelled. In this way, the rear ends of the front end chucks 82 press the front end of the printing plate 12 against the peripheral surface of the rotating drum 80 due to the aforementioned elastic force, such that the front end of the printing plate 12 is fixed to the peripheral surface of the rotating drum 80. Moreover, when the front end of the printing plate 12 is fixed to the peripheral surface of the rotating drum 80, the rotating drum 80 is rotated in the direction of arrow D in FIG. 1, such that the printing plate 12 is trained around the peripheral surface of the rotating drum 80.

A cylindrical squeeze roller 86 is disposed in a vicinity of the peripheral surface of the rotating drum 80, at the arrow D direction side (in FIG. 1) of the attaching unit 84. The rotating drum 80 is rotated while the printing plate 12 trained therearound is pressed thereagainst due to the squeeze roller 86 moving toward the rotating drum 80. The printing plate 12 is thereby brought into close contact with the peripheral surface of the rotating drum 80.

A rear end chuck attaching/detaching unit 88 is disposed in a vicinity of the outer periphery of the rotating drum 80, at the arrow E direction side (in FIG. 1) of the attaching unit 84. Rear end chucks 90 are held at the rear end chuck attaching/detaching unit 88. When the rear end of the printing plate 12 trained around the rotating drum 80 opposes the rear end chuck attaching/detaching unit 88, the rear end chuck attaching/detaching unit 88 moves the rear end chucks 90 toward the rotating drum 80, and attaches them to predetermined positions of the rotating drum 80. Simultaneously, the rear end chucks 90 are separated from the rear end chuck attaching/detaching unit 88. In this way, the rear end chucks 90 press the rear end of the printing plate 12, such that the rear end of the printing plate 12 is fixed to the outer periphery of the rotating drum 80.

When the front end and the rear end of the printing plate 12 are fixed to the rotating drum 80 by the front end chucks 82 and the rear end chucks 90 in this way, the rear end chuck attaching/detaching unit 88 and the squeeze roller 86 are moved away from the rotating drum 80. Thereafter, the rotating drum 80 is rotated at high speed at a predetermined rotational speed.

A recording head 92 is disposed in a vicinity of the rear side of the peripheral surface of the rotating drum 80. The recording head 92 faces the rotating drum 80 which is rotating at high speed. Synchronously with the rotation of the rotating drum 80, the recording head 92 illuminates a light beam which is modulated on the basis of read image data. The printing plate 12 is thereby exposed on the basis of the image data. This exposure processing is so-called scan-exposure in which the recording head 92 is moved in the axial direction of the rotating drum 80 (subscanning) while the rotating drum 80 is rotated at high speed in the peripheral direction (main scanning).

When the scan-exposure of the printing plate 12 is completed, the rotating drum 80 is stopped for a time at a position at which the rear end chucks 90 oppose the rear end chuck attaching/detaching unit 88. The rear end chuck attaching/detaching unit 88 is moved toward the rotating drum 80. The rear end chucks 90 are removed from the rotating drum 80 by the rear end chuck attaching/detaching unit 88 which has moved. Simultaneously therewith, the rear end chucks 90 are held by the rear end chuck attaching/detaching unit 88. The fixing of the rear end of the printing plate 12 by the rear end chucks 90 is thereby cancelled. Thereafter, the rear end chucks 90 are moved away from the rotating drum 80 by the rear end chuck attaching/detaching unit 88.

Moreover, after the conveying guide unit 70 has been rotated such that the plate discharging guide 74 corresponds to the exposure section 78 (i.e., after the plate discharging guide 74 is made to correspond to a direction tangent to the rotating drum 80), the rotating drum 80 is rotated in the direction of arrow E in FIG. 1. In this way, the printing plate 12 is conveyed rearward from the rear end side thereof, and is discharged to the plate discharging guide 74. At this time, due to the extending/retracting rods 84A of the attaching unit 84 being extended such that the front sides of the front end chucks 82 are pushed, the fixing of the front end of the printing plate 12 by the front end chucks 82 is released.

Moreover, when the printing plate 12 is fed to the plate discharging guide 74, the conveying guide unit 70 is rotated, and the printing plate 12 is discharged out from the plate discharging guide 74. In this way, the printing plate 12 is conveyed to a developing device (not illustrated) which is the subsequent process.

Next, operation of the present embodiment will be described.

In the automatic printing plate exposure device 10 having the above-described structure, the interleaf sheets 20 and the printing plates 12 are stacked alternately in each cassette 16 of the sheet feeding/conveying section 14. When the upper cassette 16 is disposed at the rear side position, the bottom ends of the suction pads 36 are contacted by the uppermost interleaf sheet 20 in the upper cassette 16. Further, when the upper cassette 16 is disposed at the front side position, the bottom ends of the suction pads 36 are contacted by the uppermost interleaf sheet 20 in the lower cassette 16. When the suction mechanism is driven in the state in which the bottom ends of the suction pads 36 contact the uppermost interleaf sheet 20 in the cassette 16, air is sucked from the suction pads 36 to the suction mechanism, and that interleaf sheet 20 and the printing plate 12 therebeneath are sucked by the suction pads 36. Due to the suction pads 36 being moved directly upward and that interleaf sheet 20 and printing plate 12 being raised up and conveyed, the interleaf sheet 20 and the printing plate 12 beneath that interleaf sheet 20 and printing plate 12 are separated by the separating plate 18 of the cassette 16. In this way, the interleaf sheet 20 and the printing plate 12 are removed pair-by-pair from the cassette 16.

Thereafter, due to the suction pads 36 moving forward while rotating counterclockwise in FIG. 1, the bottom ends of the suction pads 36 move while tracing a cycloid curve, and the interleaf sheet 20 and the printing plate 12 sucked by the suction pads 36 are inverted and conveyed. When the suction pads 36 are oriented directly upward, the rotation of the suction pads 36 is stopped. The interleaf sheet 20 and the printing plate 12 are transferred to between the pair of conveying rollers 42, and the sucking of the interleaf sheet 20 and the printing plate 12 to the suction pads 36 is cancelled. The interleaf sheet 20 and the printing plate 12 are thereby conveyed substantially forward along the guide plate 44.

At the time when the interleaf sheet 20, which is being conveyed substantially forward together with the printing plate 12 along the guide plate 44, is conveyed on the top surface of the belt 54, the interleaf sheet 20 is sucked to the belt 54 by the fan 56 via the mesh holes, and is peeled off from the printing plate 12. In this way, only the interleaf sheet 20 is guided between the pair of guide rollers 46, and thereafter, is fed to the pair of discharge rollers 48 while being guided by the interleaf sheet guide plate 52. In this way, only the interleaf sheet 20 is discarded in the discard box. On the other hand, the printing plate 12 from which the interleaf sheet 20 has been peeled off continues to be conveyed substantially forward along the guide plate 44.

The printing plate 12 which is conveyed substantially forward along the guide plate 44 is conveyed to the plate supplying guide 72 of the conveying guide unit 70. The conveying guide unit 70 is rotated such that the plate supplying guide 72 is made to correspond to the puncher portion 76. The front end portion of the printing plate 12 is thereby conveyed into the puncher portion 76. After a predetermined number of punch holes have been formed by the puncher portion 76 in the front end portion of the printing plate 12 which has been conveyed therein, the printing plate 12 is returned onto the plate supplying guide 72.

Then, due to the conveying guide unit 70 being rotated and the plate supplying guide 72 being made to correspond to the rotating drum 80 of the exposure section 78, the printing plate 12 is conveyed to the rotating drum 80 and is positioned thereat. The front end and the rear end of the positioned printing plate 12 are fixed to the peripheral surface of the rotating drum 80 by the front end chucks 82 and the rear end chucks 90, respectively. Further, the printing plate 12 is trained around the peripheral surface of the rotating drum 80 while being brought into close contact thereto by the squeeze roller 86. When the printing plate 12 has been trained around the peripheral surface of the rotating drum 80, in the state in which the rotating drum 80 is rotated at high speed, a light beam is irradiated from the recording head 92 onto the printing plate 12. In this way, exposure processing of the printing plate 12 is carried out.

When the exposure processing is completed, the conveying guide unit 70 is rotated, the plate discharging guide 74 is made to correspond to the rotating drum 80, the fixing of the printing plate 12 to the peripheral surface of the rotating drum 80 by the front end chucks 82 and the rear end chucks 90 is released, and the printing plate 12 is discharged from the rotating drum 80 to the plate discharging guide 74. Thereafter, the conveying guide unit 70 is rotated, and the printing plate 12 is discharged from the plate discharging guide 74. The printing plate 12 is thereby conveyed to the developing device which is the subsequent process.

In the sheet feeding/conveying section 14, at the robot arm mechanism 22, the moving plate 26 can move in the front-back direction along the pair of rails 24. Further the rotating arm 28 is rotatably supported at the moving plate 26, and the supporting plate 34 and the suction pads 36 are rotatably supported at the rotating arm 28. In this way, the printing plate 12 and the interleaf sheet 20 are conveyed by at least one of front-back direction movement of the moving plate 26, rotation of the rotating arm 28 with respect to the moving plate 26, and rotation of the supporting plate 34 and the suction pads 36 with respect to the rotating arm 28, in the state in which the suction pads 36 are sucking (holding) the printing plate 12 and the interleaf sheet 20.

Here, the suction pads 36 can move due to the front-back direction movement of the moving plate 26, the rotation of the rotating arm 28 with respect to the moving plate 26, and the rotation of the supporting plate 34 and the suction pads 36 with respect to the rotating arm 28. Therefore, the region over which the suction pads 36 can move is large in the vertical direction in particular, and the suction pads 36 can suck the printing plate 12 and the interleaf sheet 20 which are in this large region over which movement of the suction pads 36 is possible. In this way, the distance over which the upper cassette 16 (including the printing plate 12 and the interleaf sheet 20) is horizontally moved (the horizontal distance between the front side position and the rear side position of the upper cassette 16) in order for the suction pads 36 to suck the printing plate 12 and the interleaf sheet 20 in the upper cassette 16, can be made to be small. Moreover, the distance over which the lower cassette 16 (including the printing plate 12 and the interleaf sheet 20) is horizontally moved in order for the suction pads 36 to suck the printing plate 12 and the interleaf sheet 20 in the lower cassette 16 can be eliminated. Accordingly, the space occupied by the sheet feeding/conveying section 14 in the front-back direction can be made to be small, and the sheet feeding/conveying section 14 can be made to be compact. In addition, the mechanism for moving the upper cassette 16 can be made to be compact, and the mechanism for moving the lower cassette 16 can be eliminated, such that costs can be reduced.

It suffices to set the horizontal distance (the amount of offset) of the front side position from the rear side position of the upper cassette 16 such that, at least at the time when the interleaf sheet 20 and the printing plate 12 are being lifted up from the lower cassette 16 and conveyed (i.e., when they are being conveyed directly upward) and at the time when the interleaf sheet 20 and the printing plate 12 are being inverted and conveyed, that interleaf sheet 20 and printing plate 12 do not interfere with the upper cassette 16. Therefore, the horizontal distance from the rear side position to the front side position of the upper cassette 16 can well be made to be small, and accordingly, the sheet feeding/conveying section 14 can well be made to be compact.

Further, even when there is the upper cassette 16 (an obstacle) at the side in the direction of lifting up and conveying the interleaf sheet 20 and the printing plate 12 from the lower cassette 16 (i.e., at the upper side of the lower cassette 16), the printing plate 12 can be prevented from being damaged by the upper cassette 16 due to the suction pads 36 being moved directly upward by the front-back direction movement of the moving plate 26, the rotation of the rotating arm 28 with respect to the moving plate 26, and the rotation of the supporting plate 34 and the suction pads 36 with respect to the rotating arm 28.

Moreover, the suction pads 36 can rotate due to the rotation of the rotating arm 28 with respect to the moving plate 26, and the rotation of the supporting plate 34 and the suction pads 36 with respect to the rotating arm 28. Therefore, the angle of the suction pads 36 with respect to the interleaf sheet 20 and the printing plate 12 within the cassette 16 can be adjusted. In this way, due to the bottom ends of the suction pads 36 being set parallel to the interleaf sheet 20 and the printing plate 12, the suction pads 36 can reliably suck that interleaf sheet 20 and printing plate 12.

Further, the front-back direction movement of the moving plate 26, the rotation of the rotating arm 28 with respect to the moving plate 26, and the rotation of the supporting plate 34 and the suction pads 36 with respect to the rotating arm 28, are driven by respectively different drive sources, and are respectively controlled independently. Therefore, the position and the angle at which the suction pads 36 suck the interleaf sheet 20 and the printing plate 12 can be selected from a wide range, and the locus of conveying and the conveying direction of the interleaf sheet 20 and the printing plate 12 can be selected from a wide range.

MODIFIED EXAMPLE

Figure 4:
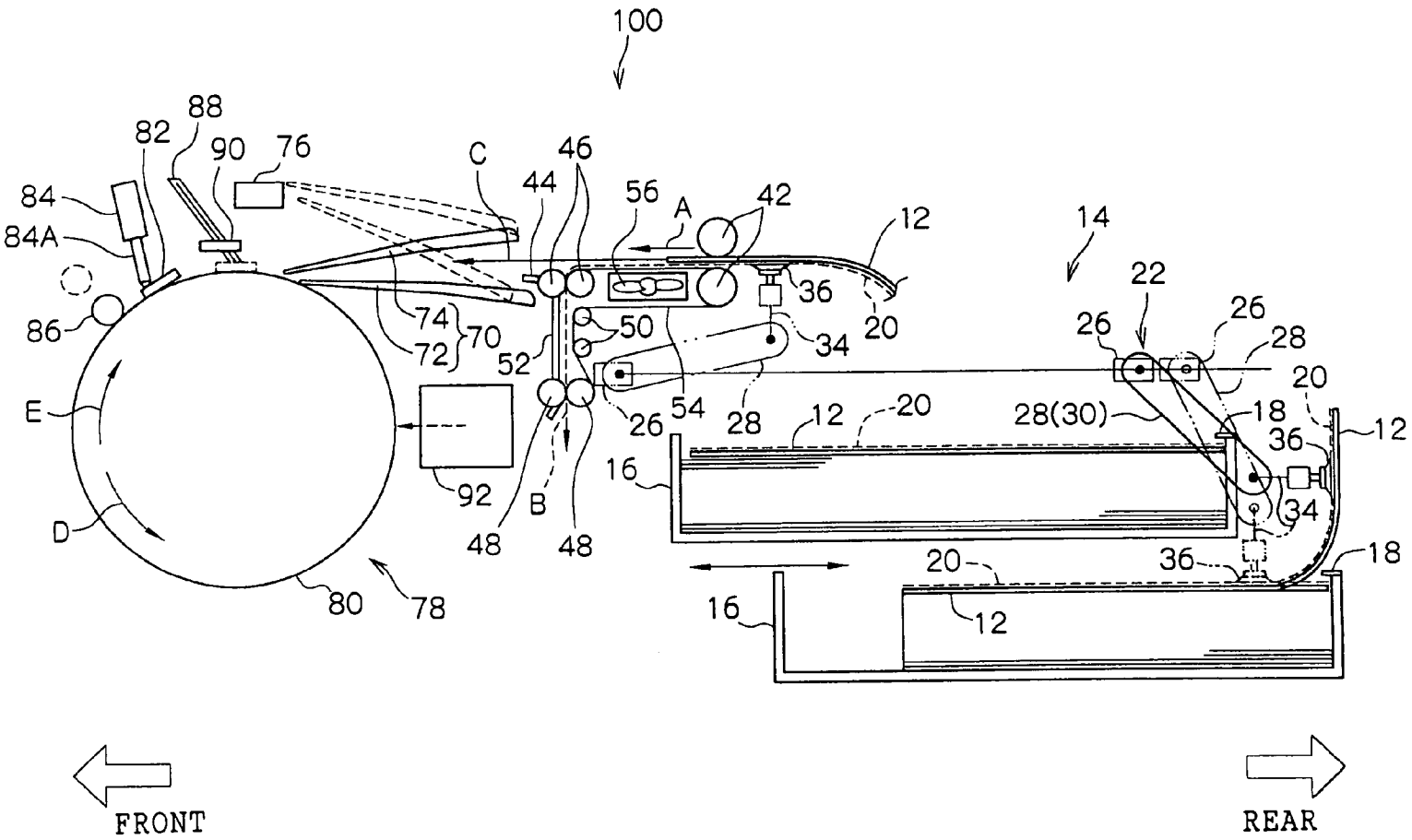
FIG. 4 is a schematic side view of the automatic printing plate exposure device to which a modified example of the conveying device relating to the embodiment of the present invention is applied.

An automatic printing plate exposure device 100 relating to a modified example of the above-described embodiment is shown in side view in FIG. 4.

The automatic printing plate exposure device 100 relating to the present modified example has substantially the same structure as that of the automatic printing plate exposure device 10 relating to the above-described embodiment. However, as will be described hereinafter, the method of conveying the interleaf sheet 20 and the printing plate 12 from the lower cassette 16 is partly different.

Namely, when the interleaf sheet 20 and the printing plate 12 are lifted up and conveyed from the lower cassette 16 in a state in which the portions thereof sucked by the suction pads 36 are horizontal, and the interleaf sheet 20 and the printing plate 12 pass by the separating plate 18 of the lower cassette 16, the supporting plate 34 and the plurality of suction pads 36 are rotated counterclockwise in FIG. 4 with respect to the rotating arm 28. In this way, the plural suction pads 36 are oriented rearward (i.e., are disposed horizontally), and the end portion of the interleaf sheet 20 and the printing plate 12 which is sucked by the suction pads 36 is directed upward.

Then, the moving plate 26 is moved in the front-back direction, the rotating arm 28 is rotated counterclockwise in FIG. 4 with respect to the moving plate 26, and the supporting plate 34 and the plural suction pads 36 are rotated clockwise in FIG. 4 with respect to the rotating arm 28. In this way, the plural suction pads 36 are moved directly upward while still in the state of being oriented rearward, and the interleaf sheet 20 and the printing plate 12 are raised (picked-up) and conveyed while still in the state in which the rear portion thereof sucked by the suction pads 36 is directed upward. Then, the moving plate 26 and the rotating arm 28 pass through the top suction position and reach the inversion starting position.

When the moving plate 26 and the rotating arm 28 reach the inversion starting position, the moving plate 26 is moved forward, the rotating arm 28 is rotated counterclockwise in FIG. 4 with respect to the moving plate 26, and the supporting plate 34 and the plural suction pads 36 are rotated counterclockwise in FIG. 4 with respect to the rotating arm 28. In this way, the plural suction pads 36 are moved, and the interleaf sheet 20 and the printing plate 12 are inverted and conveyed.

Here, effects which are similar to those of the above-described embodiment can be obtained by the automatic printing plate exposure device 100 relating to the present modified example as well.

In addition, the suction pads 36 move the end portion of the printing plate 12 and the interleaf sheet 20 from the lower cassette 16 directly upward while sucking this end portion in a state in which this end portion is directed upward. The printing plate 12 and the interleaf sheet 20 thereby pass along the rear (the side) of the upper cassette 16, and are conveyed upward. Therefore, due to the non-flexing force of the printing plate 12 and the interleaf sheet 20, it is possible to suppress horizontal direction spreading of the regions of the printing plate 12 and the interleaf sheet 20 other than this end portion. In this way, the region which is passed by at the time when the printing plate 12 and the interleaf sheet 20 are lifted up and conveyed can be made to be small.

Accordingly, even if the horizontal distance (the amount of offset) of the front side position from the rear side position of the upper cassette 16 is made to be smaller than in the previously-described embodiment (i.e., even if the front side position of the upper cassette 16 is made to be closer to the rear side position than in the above-described embodiment), it is possible to prevent the interleaf sheet 20 and the printing plate 12 from interfering with the upper cassette 16. Further, even if the distance by which the bottom end of the upper cassette 16 and the top end of the lower cassette 16 are separated from one another in the vertical direction (i.e., the vertical direction interval between the upper cassette 16 and the lower cassette 16) is made to be small, it is possible to prevent the interleaf sheet 20 and the printing plate 12 from interfering with the upper cassette 16. Thus, the space occupied by the sheet feeding/conveying section 14 in the front-back direction can be made to be even smaller, the space occupied by the sheet feeding/conveying section 14 in the vertical direction can be made to be smaller, and the sheet feeding/conveying section 14 can be made to be more compact.

Further, because horizontal direction spreading of the regions of the printing plate 12 and the interleaf sheet 20 other than the end portion thereof sucked by the suction pads 36 can be suppressed, it is possible to even further prevent the printing plate 12 from being damaged by the upper cassette 16, which is at the lifting-up/conveying direction side (i.e., the upper side) of the interleaf sheet 20 and the printing plate 12 and which could be an obstacle on the conveying path.

Note that, in the above-described embodiment and modified example, the upper cassette 16 is structured so as to be movable between the front side position and the rear side position. However, a structure is possible in which the upper cassette is always disposed at the front side position. In such a case, by shifting forward the top sucking position at which the suction pads suck (hold) the interleaf sheet and the printing plate (the sheet) within the upper cassette, the suction pads can suck that interleaf sheet and printing plate.

In addition, in the above-described embodiment and modified example, a structure is used in which the printing plate 12 is automatically fed to between the pair of conveying rollers 42 due to the conveying of the printing plate 12 by the suction pads 36. However, a structure is possible in which, at that same time, the printing plate (sheet) is fed between the pair of conveying rollers by manual insertion (manual feeding).

Moreover, in the above-described embodiment and modified example, the suction pads 36 simultaneously suck and convey the interleaf sheet 20 and the printing plate 12. However, a structure is possible in which the suction pads (the holding member) suck (hold) and convey the interleaf sheet and the printing plate (sheet) separately.

As described above, in the conveying device relating to the embodiments of the present invention, the holding member can move due to movement of the moving member, the rotation of the rotating member with respect to the moving member, and the rotation of the holding member with respect to the rotating member. Therefore, the distance over which the sheet is moved in order for the holding member to hold the sheet can be made to be small or can be eliminated, the conveying device can be made compact, and the cost can be decreased.

Moreover, even in cases in which there is an obstacle at the conveying direction side of the sheet, by moving the holding member, it is possible to suppress or prevent the sheet from being damaged by the obstacle.

Because the holding member can rotate, the angle of the holding member with respect to the sheet can be adjusted, and the holding member can reliably hold the sheet.

In the conveying device relating to the embodiments of the present invention, the movement of the moving member, the rotation of the rotating member with respect to the moving member, and the rotation of the holding member with respect to the rotating member can respectively be controlled independently. Therefore, the position and the angle at which the holding member holds the sheet can be selected from a wide range, and the locus of conveying of the sheet and the conveying direction of the sheet can be selected from a wide range.

In addition, the sheet is conveyed upward due to the holding member being moved upward while holding the end portion of the sheet in a state in which that end portion is directed upward. Therefore, the region which the sheet passes through at the time when the sheet is being conveyed can be made to be small, and the conveying device can be made to be compact.

Horizontal direction spreading of the regions of the sheet other than the end portion thereof held by the holding member can be suppressed. Therefore, it is possible to suppress or prevent the sheet from being damaged by an obstacle located at the conveying direction side of the sheet.

Moreover, by rotating the holding member and adjusting the angle of the holding member with respect to the sheet, the holding member can reliably hold the sheet.

What is claimed is:

1. A conveying device comprising:

a cassette stacking a plurality of sheets in a vertical direction;

a moving member disposed parallel to a surface of each of the sheets and movable in at least a horizontal direction, the horizontal direction being parallel to the surface of each of the sheets;

a rotating member rotatably supported at the moving member; and a holding member rotatably supported at the rotating member, and able to hold the sheet, wherein, in a state in which the holding member is holding the sheet, the holding member conveys the sheet by at least one of movement of the moving member, rotation of the rotating member with respect to the moving member, and rotation of the holding member with respect to the rotating member.

2. The conveying device of claim 1, wherein the movement of the moving member, the rotation of the rotating member with respect to the moving member, and the rotation of the holding member with respect to the rotating member are driven by respectively different drive sources, and each of the drive sources is controlled independently.

3. The conveying device of claim 1, further comprising a restricting member, wherein the moving member engages with the restricting member, and the moving member moves along the restricting member.

4. The conveying device of claim 1, wherein the holding member is formed from a suction member which can hold the sheet by suction.

5. The conveying device of claim 1, wherein, in the state in which the holding member is holding the sheet, due to at least the rotating member rotating, the holding member moves and conveys the sheet to a position substantially opposing a position at which the holding member first holds the sheet.

6. The conveying device of claim 1, wherein, given that a direction of thickness of the sheet is a vertical direction, the holding member holds one end portion of the sheet such that the one end portion is oriented in the vertical direction, and moves and conveys the sheet in the direction in which the one end portion is oriented.

7. The conveying device of claim 6, wherein the holding member is provided so as to be rotatable.

8. The conveying device of claim 6, wherein the holding member is formed from a suction member which can hold the sheet by suction.

9. A method of conveying a sheet by a conveying device having: a cassette stacking a plurality of sheets in a vertical direction; a moving member disposed parallel to a surface of each of the sheets and moveable in at least a horizontal direction, the horizontal direction being parallel to the surface of each of the sheets; a rotating member rotatably supported at the moving member; and a holding member rotatably supported at the rotating member and able to hold the sheet, said method comprising:

holding the sheet by the holding member; and conveying the sheet by at least one of movement of the moving member, rotation of the rotating member with respect to the moving member, and rotation of the holding member with respect to the rotating member.

10. The conveying method of claim 9, wherein the holding member holds a vicinity of one end portion of the sheet.

11. The conveying method of claim 9, wherein the holding member holds the sheet by suction.

12. A printing plate exposure device comprising:

a plurality of cassettes disposed in a row in a vertical direction, each of the cassettes accommodating a plurality of printing plates;

a conveying device conveying the printing plate and having: a moving member disposed parallel to the plurality of cassettes and provided so as to be movable in a horizontal direction; a rotating member rotatably supported at the moving member; and a holding member rotatably supported at the rotating member and able to hold the printing plate; and an exposure section provided at a downstream side of the conveying device in a direction of conveying the printing plate, and recording an image on a conveyed printing plate, wherein, in a state in which the holding member is holding the printing plate, the holding member conveys the printing plate by at least one of movement of the moving member, rotation of the rotating member with respect to the moving member, and rotation of the holding member with respect to the rotating member.

13. The printing plate exposure device of claim 12, wherein the movement of the moving member, the rotation of the rotating member with respect to the moving member, and the rotation of the holding member with respect to the rotating member are driven by respectively different drive sources, and each of the drive sources is controlled independently.

14. The printing plate exposure device of claim 12, wherein, in the state in which the holding member is holding the printing plate, due to at least the rotating member rotating, the holding member moves and conveys the printing plate to a position substantially opposing a position at which the holding member first holds the printing plate.

15. The printing plate exposure device of claim 12, wherein the plurality of cassettes are disposed so as to be offset from one another in the horizontal direction.

16. The printing plate exposure device of claim 12, wherein the plurality of cassettes are provided so as to be movable in the horizontal direction.

* * * * *